US011667121B2

(12) United States Patent
Nagatsuka

(10) Patent No.: US 11,667,121 B2
(45) Date of Patent: Jun. 6, 2023

(54) MAINTENANCE DEVICE, LIQUID DISCHARGE APPARATUS, MAINTENANCE METHOD, AND NON-TRANSITORY RECORDING MEDIUM

(71) Applicant: Yuki Nagatsuka, Kanagawa (JP)

(72) Inventor: Yuki Nagatsuka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 39 days.

(21) Appl. No.: 17/461,843

(22) Filed: Aug. 30, 2021

(65) Prior Publication Data

US 2022/0105729 A1 Apr. 7, 2022

(30) Foreign Application Priority Data

Oct. 1, 2020 (JP) ..... JP2020-167359

(51) Int. Cl.
*B41J 2/165* (2006.01)

(52) U.S. Cl.
CPC ..... *B41J 2/16535* (2013.01); *B41J 2/16523* (2013.01); *B41J 2/16579* (2013.01); *B41J 2002/16564* (2013.01); *B41J 2002/16573* (2013.01); *B41J 2002/16582* (2013.01)

(58) Field of Classification Search
CPC ..... B41J 2/16535; B41J 2/16523; B41J 2/16579; B41J 2002/16564; B41J 2002/16573; B41J 2002/16582; B41J 2/16517; B41J 2/16532; B41J 2/16538
See application file for complete search history.

(56) References Cited

U.S. PATENT DOCUMENTS

| | | | | |
|---|---|---|---|---|
| 11,135,850 | B2 * | 10/2021 | Hiroi | B41J 2/16585 |
| 2018/0370239 | A1 * | 12/2018 | Taira | B41J 2/16544 |
| 2019/0217623 | A1 | 7/2019 | Nagatsuka | |
| 2020/0070524 | A1 | 3/2020 | Noda et al. | |
| 2020/0101753 | A1 | 4/2020 | Nagatsuka et al. | |

FOREIGN PATENT DOCUMENTS

| | | | | |
|---|---|---|---|---|
| JP | 2011-093245 | | 5/2011 | |
| JP | 2013163301 | A * | 8/2013 | |
| JP | 2013-176900 | | 9/2013 | |
| JP | 2018-089968 | | 6/2018 | |
| WO | WO-2021126252 | A1 * | 6/2021 | B41J 2/16535 |

* cited by examiner

*Primary Examiner* — Sharon Polk

(74) *Attorney, Agent, or Firm* — Duft & Bornsen, PC

(57) ABSTRACT

A maintenance device includes a plurality of heads that discharges liquid for printing. A cleaner selectively cleans the heads. A cleaning controller controls the cleaner. A determiner determines a cleaning time when the cleaner cleans one of the heads. An interruption-resumption controller controls the heads to interrupt printing at the cleaning time and resume printing when the cleaner finishes cleaning the one of the heads. The cleaning controller controls the cleaner to clean the one of the heads whenever the interruption-resumption controller controls the heads to interrupt printing at the cleaning time.

18 Claims, 11 Drawing Sheets

MAINTENANCE DEVICE, LIQUID DISCHARGE APPARATUS, MAINTENANCE METHOD, AND NON-TRANSITORY RECORDING MEDIUM

CROSS-REFERENCE TO RELATED APPLICATION

This patent application is based on and claims priority pursuant to 35 U.S.C. § 119(a) to Japanese Patent Application No. 2020-167359, filed on Oct. 1, 2020, in the Japan Patent Office, the entire disclosure of which is hereby incorporated by reference herein.

BACKGROUND

Technical Field

Exemplary aspects of the present disclosure relate to a maintenance device, a liquid discharge apparatus, a maintenance method, and a non-transitory recording medium, and more particularly, to a maintenance device, a liquid discharge apparatus incorporating the maintenance device, a maintenance method performed by the liquid discharge apparatus, and a non-transitory recording medium used by the liquid discharge apparatus.

Discussion of the Background Art

Related-art liquid discharge apparatuses, such as copiers, facsimile machines, printers, and multifunction peripherals (MFP) having two or more of copying, printing, scanning, facsimile, plotter, and other functions, typically form an image on a recording medium according to image data.

Such liquid discharge apparatuses include an inkjet printer that includes a platen heater. As the platen heater heats a sheet serving as a recording medium conveyed through the inkjet printer, ink on the sheet evaporates. Accordingly, dew drops adhere to a nozzle face of a recording head, rendering it difficult for a nozzle to discharge liquid properly and causing the nozzle to suffer from clogging. To address this circumstance, the inkjet printer cleans the nozzle face of the recording head periodically during printing, preventing clogging of the nozzle due to the dew drops.

SUMMARY

This specification describes below an improved maintenance device. In one embodiment, the maintenance device includes a plurality of heads that discharges liquid for printing. A cleaner selectively cleans the heads. A cleaning controller controls the cleaner. A determiner determines a cleaning time when the cleaner cleans one of the heads. An interruption-resumption controller controls the heads to interrupt printing at the cleaning time and resume printing when the cleaner finishes cleaning the one of the heads. The cleaning controller controls the cleaner to clean the one of the heads whenever the interruption-resumption controller controls the heads to interrupt printing at the cleaning time.

This specification further describes an improved liquid discharge apparatus. In one embodiment, the liquid discharge apparatus includes the maintenance device described above.

This specification further describes an improved maintenance method. In one embodiment, the maintenance method includes discharging liquid from a plurality of heads for printing, determining a cleaning time when a cleaner cleans one of the heads, selecting the one of the heads to be cleaned by the cleaner, controlling the heads to interrupt printing at the cleaning time, controlling the cleaner to clean the one of the heads; and controlling the heads to resume printing when the cleaner finishes cleaning the one of the heads.

This specification further describes an improved non-transitory recording medium. In one embodiment, the non-transitory recording medium stores a plurality of instructions which, when executed by at least one processor, causes the at least one processor to perform the maintenance method described above.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
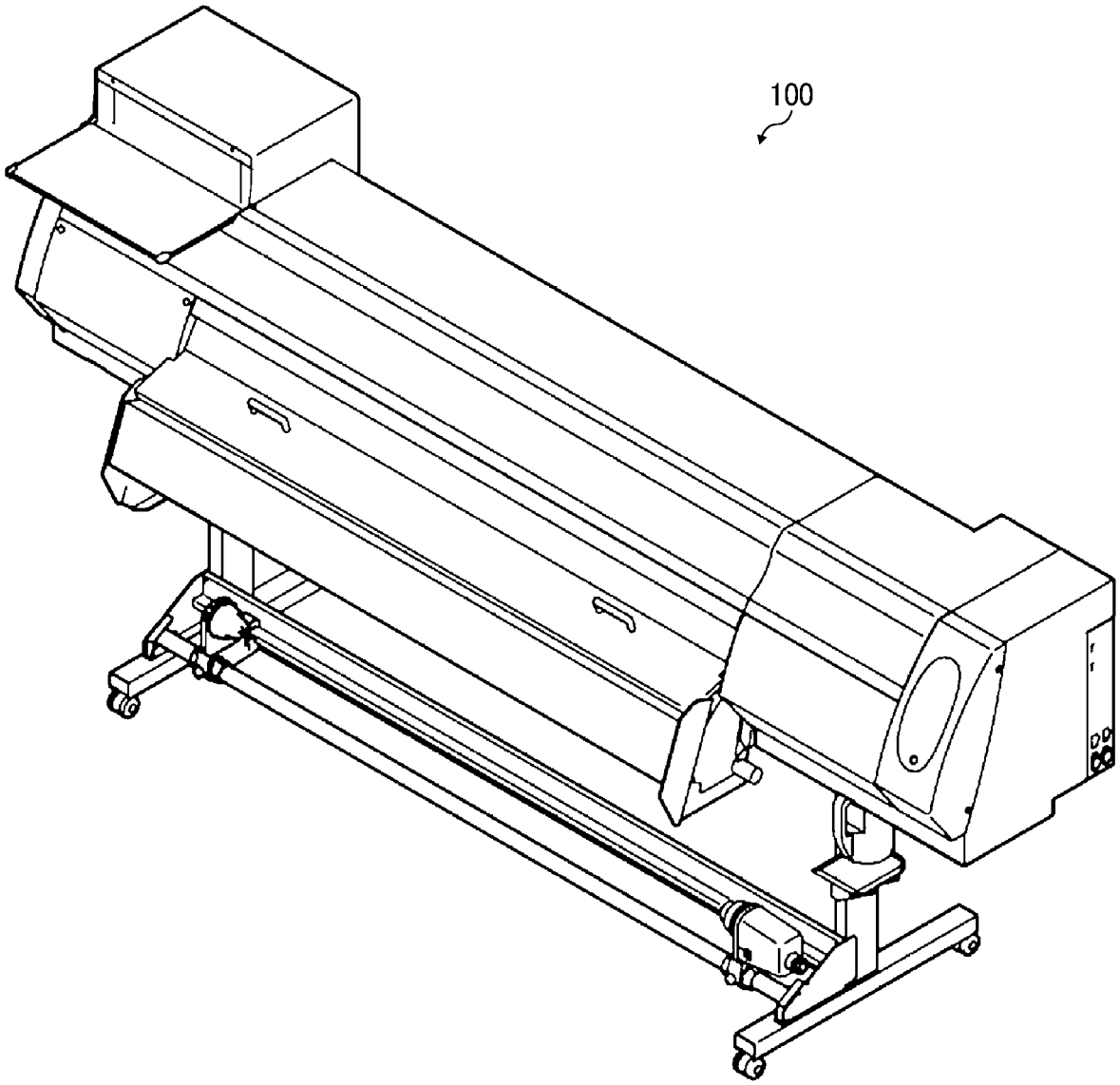
FIG. 1 is a perspective view of an inkjet printer according to a first embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring to drawings, a description is provided of a configuration of an inkjet printer as one example of a liquid discharge apparatus according to embodiments of the present disclosure. In the description below, a material of a sheet is not limited to paper and includes an overhead projector (OHP) transparency (e.g., polyester film), cloth, glass, and a substrate that are adhered with an ink droplet, other liquid, or the like. Sheets include a recorded medium, a recording medium, recording paper, and a recording sheet. Image formation, recording, printing, imaging, and the like are synonyms.

The inkjet printer may form an image by discharging liquid onto a medium such as paper, thread, fiber, cloth, leather, metal, plastic, glass, wood, and ceramic. Image formation denotes forming an image having meaning such as characters and figures and an image not having meaning such as patterns on a medium. That is, image formation also denotes merely discharging liquid (e.g., a liquid droplet) onto a medium.

Ink is a generic term of ink, recording liquid, fixing process liquid, liquid, and other liquid used to form an image, unless otherwise specified. For example, the ink also includes a deoxyribonucleic acid (DNA) sample, a resist, a pattern material, and resin.

An image is not limited to a planar image and also includes a three-dimensional image and a modeled object.

A description is provided of a mechanical configuration of an inkjet printer 100, serving as a liquid discharge apparatus, according to a first embodiment of the present disclosure.

Figure 2:
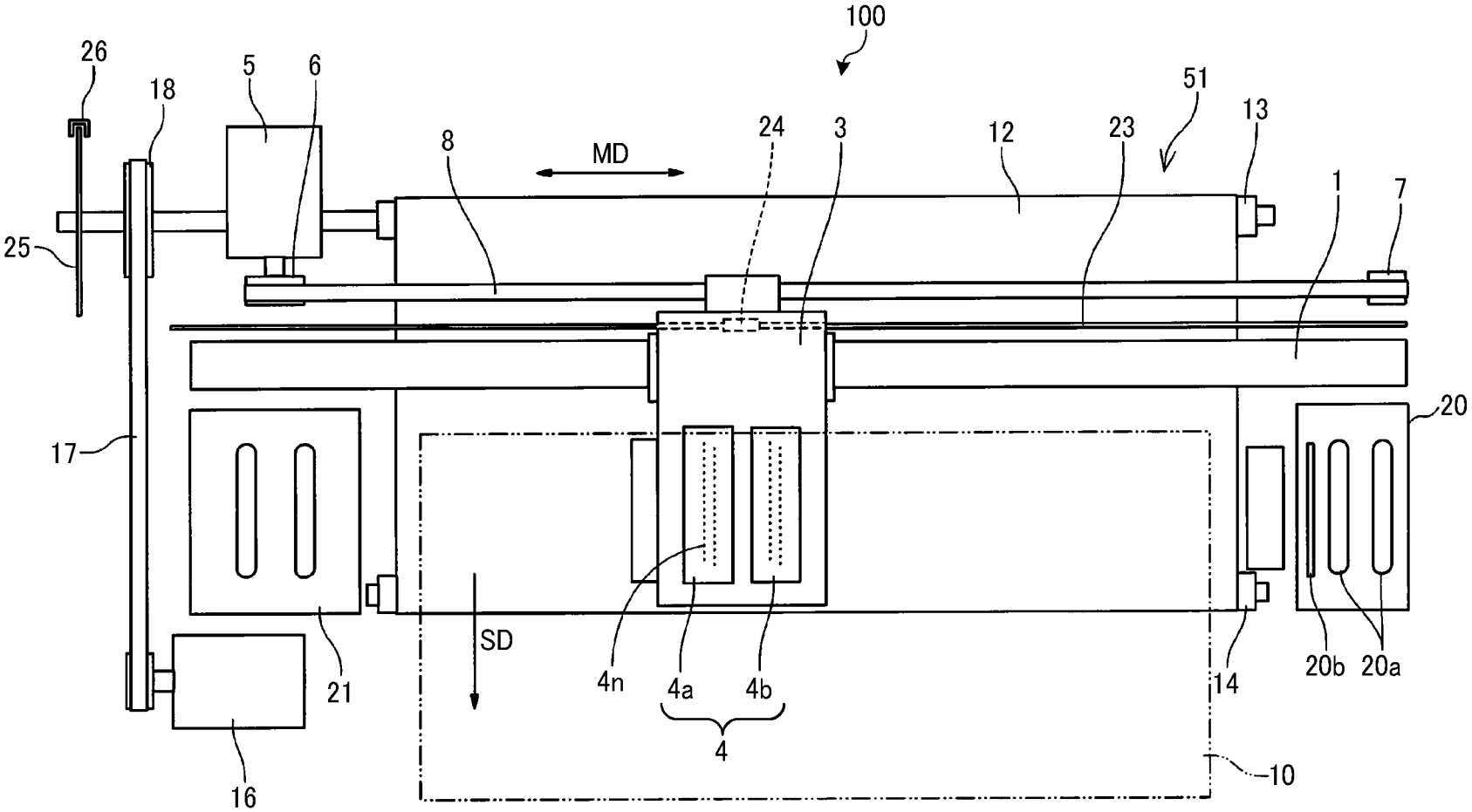
FIG. 2 is a diagram of a main section of the inkjet printer depicted in FIG. 1.

FIG. 1 is a perspective view of the inkjet printer 100 according to the first embodiment. FIG. 2 is a diagram of the inkjet printer 100 according to the first embodiment, illustrating a construction of a main section of the inkjet printer 100. As illustrated in FIGS. 1 and 2, the inkjet printer 100 according to the first embodiment is a serial type inkjet printer. A main guide 1 and a sub guide laterally bridge side plates, that is, a left side plate and a right side plate, respectively, in FIG. 2. The main guide 1 and the sub guide movably support a carriage 3. A main scanning motor 5 moves the carriage 3 reciprocally in a main scanning direction MD (e.g., a moving direction of the carriage 3) through a timing belt 8 looped over a driving pulley 6 and a driven pulley 7.

The carriage 3 mounts recording heads 4*a* and 4*b* serving as liquid discharge heads. The recording heads 4*a* and 4*b* are mentioned as recording heads 4 if the recording head 4*a* is not distinguished from the recording head 4*b*. For example, the recording heads 4 discharge ink droplets in yellow (Y), cyan (C), magenta (M), and black (K), respectively. The recording head 4 includes a plurality of rows of nozzles. Each of the rows is aligned with a plurality of nozzles in a sub-scanning direction SD perpendicular to the main scanning direction MD. Each of the nozzles is oriented to discharge ink droplets downward.

Figure 3:
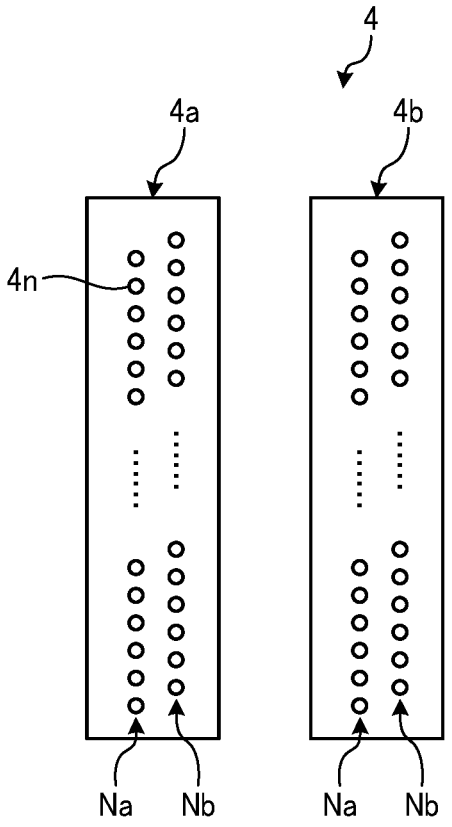
FIG. 3 is a diagram of recording heads incorporated in the inkjet printer depicted in FIG. 2.

For example, as illustrated in FIG. 3, each of the recording heads 4*a* and 4*b* includes two nozzle rows Na and Nb. Each of the nozzle rows Na and Nb includes a plurality of nozzles 4*n*. The nozzles 4*n* in one of the nozzle rows Na and Nb of the recording head 4*a*, that is, the nozzle row Na, discharge liquid in black. The nozzles 4*n* in another one of the nozzle rows Na and Nb of the recording head 4*a*, that is, the nozzle row Nb, discharge liquid in cyan. The nozzles 4*n* in one of the nozzle rows Na and Nb of the recording head 4*b*, that is, the nozzle row Na, discharge liquid in magenta. The nozzles 4*n* in another one of the nozzle rows Na and Nb of the recording head 4*b*, that is, the nozzle row Nb, discharge liquid in yellow.

For example, the recording head 4 is a thermal actuator that uses phase change by film boiling of liquid with a piezoelectric actuator such as a piezoelectric element and a thermoelectric conversion element such as a heat generation resistor.

As illustrated in FIG. 2, the inkjet printer 100 further includes a conveyer 51 that conveys a sheet 10 such that the sheet 10 is disposed opposite the recording heads 4. The conveyer 51 includes a conveying belt 12. The conveying belt 12 is an endless belt looped over a conveying roller 13 and a tension roller 14. As a sub-scanning motor 16 drives and rotates the conveying roller 13 through a timing belt 17 and a timing pulley 18, the conveying belt 12 rotates in the sub-scanning direction SD. While the conveying belt 12 rotates, a charging roller charges the conveying belt 12, thus applying electric charge to the conveying belt 12.

A maintenance-restoration mechanism 20 is disposed opposite one lateral end of each of the carriage 3 and the conveying belt 12 in the main scanning direction MD. The maintenance-restoration mechanism 20 performs maintenance and restoration of the recording heads 4. A dummy discharging receiver 21 is disposed opposite another lateral end of each of the carriage 3 and the conveying belt 12 in the main scanning direction MD. The dummy discharging receiver 21 receives dummy liquid droplets discharged from the recording heads 4.

For example, the maintenance-restoration mechanism 20 includes caps 20*a*, a wiper 20*b*, and a dummy discharging receiver. Each of the caps 20*a* caps a nozzle face of the recording head 4, that mounts the nozzles 4*n*. The wiper 20*b* wipes the nozzle face of the recording head 4. The dummy discharging receiver receives dummy liquid droplets that are not used for image formation.

As one example, the wiper 20*b* is a web wiper that does not damage the nozzle face of the recording head 4 even when the wiper 20*b* cleans the nozzle face that is not wet with ink.

An encoder scale 23 formed with a predetermined pattern is interposed between the side plates in the main scanning direction MD of the carriage 3. The carriage 3 mounts a main scanning encoder sensor 24, that is, a transmission type photosensor, that reads the pattern on the encoder scale 23. The encoder scale 23 and the main scanning encoder sensor 24 construct a linear encoder (e.g., a main scanning encoder) that detects motion of the carriage 3.

A code wheel 25 is mounted on a shaft of the conveying roller 13. The code wheel 25 is disposed opposite a sub-scanning encoder sensor 26, that is, a transmission type photosensor, that detects a pattern on the code wheel 25. The code wheel 25 and the sub-scanning encoder sensor 26 construct a rotary encoder (e.g., a sub-scanning encoder) that detects a moving amount and a position of the conveying belt 12.

In the inkjet printer 100 having the mechanical configuration described above, the conveying belt 12 that is charged attracts the sheet 10 conveyed from a sheet tray. As the conveying belt 12 rotates, the conveying belt 12 conveys the sheet 10 in the sub-scanning direction SD. As the carriage 3 moves in the main scanning direction MD, the recording heads 4 are driven according to an image signal. The recording heads 4 discharge ink droplets onto the sheet 10 conveyed by the conveying belt 12 and halted, recording an image or the like in a single line. Thereafter, the conveying belt 12 conveys the sheet 10 for a predetermined amount in the sub-scanning direction SD, recording an image or the like in a next line. Those operations are repeated to print an image or the like in each line on the sheet 10. After printing, the sheet 10 is ejected onto a sheet ejection tray.

A description is provided of an electrical configuration of the inkjet printer 100.

Figure 4A:
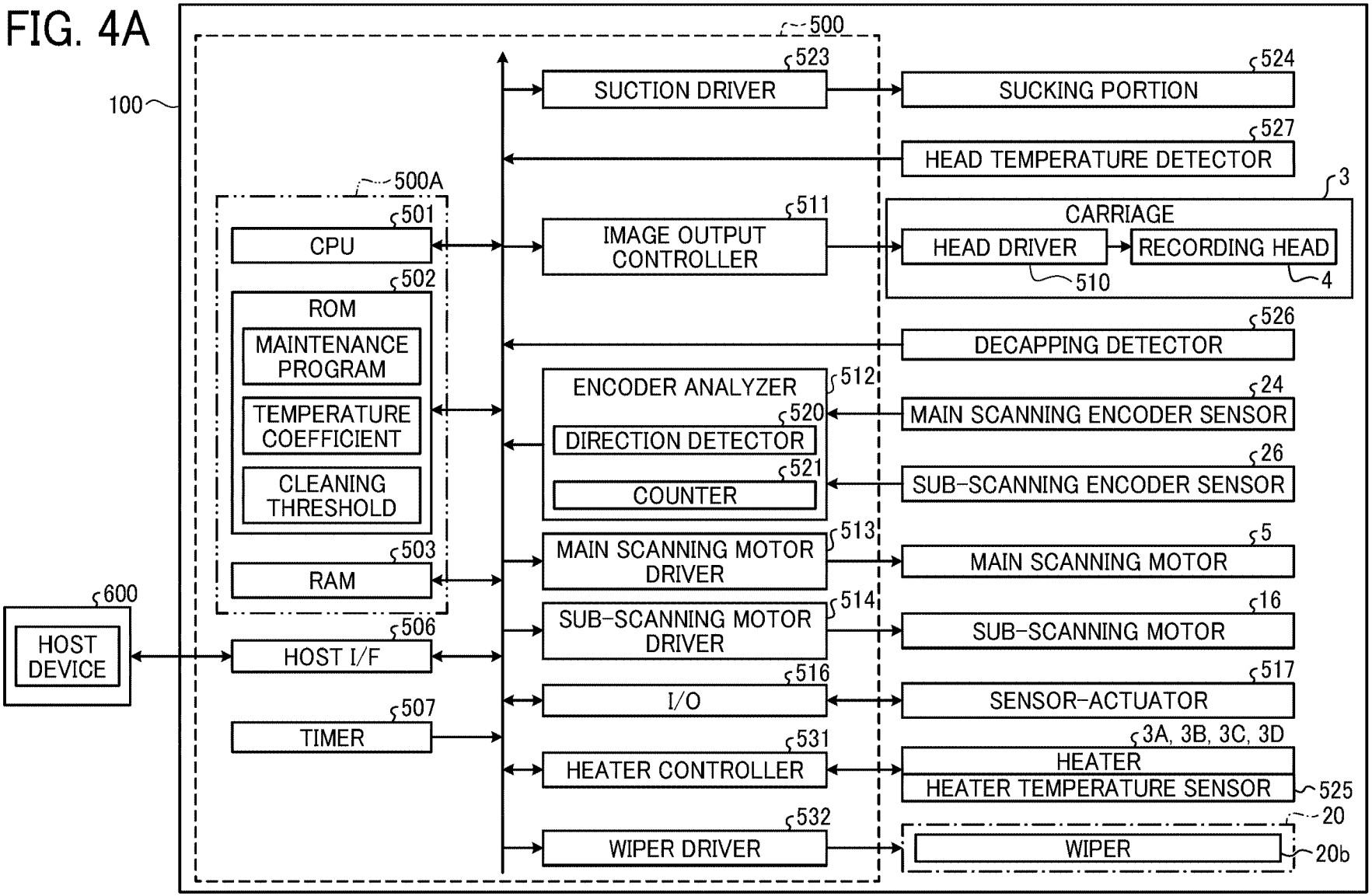
FIG. 4A is a block diagram of the inkjet printer depicted in FIG. 1.
Figure 4B:
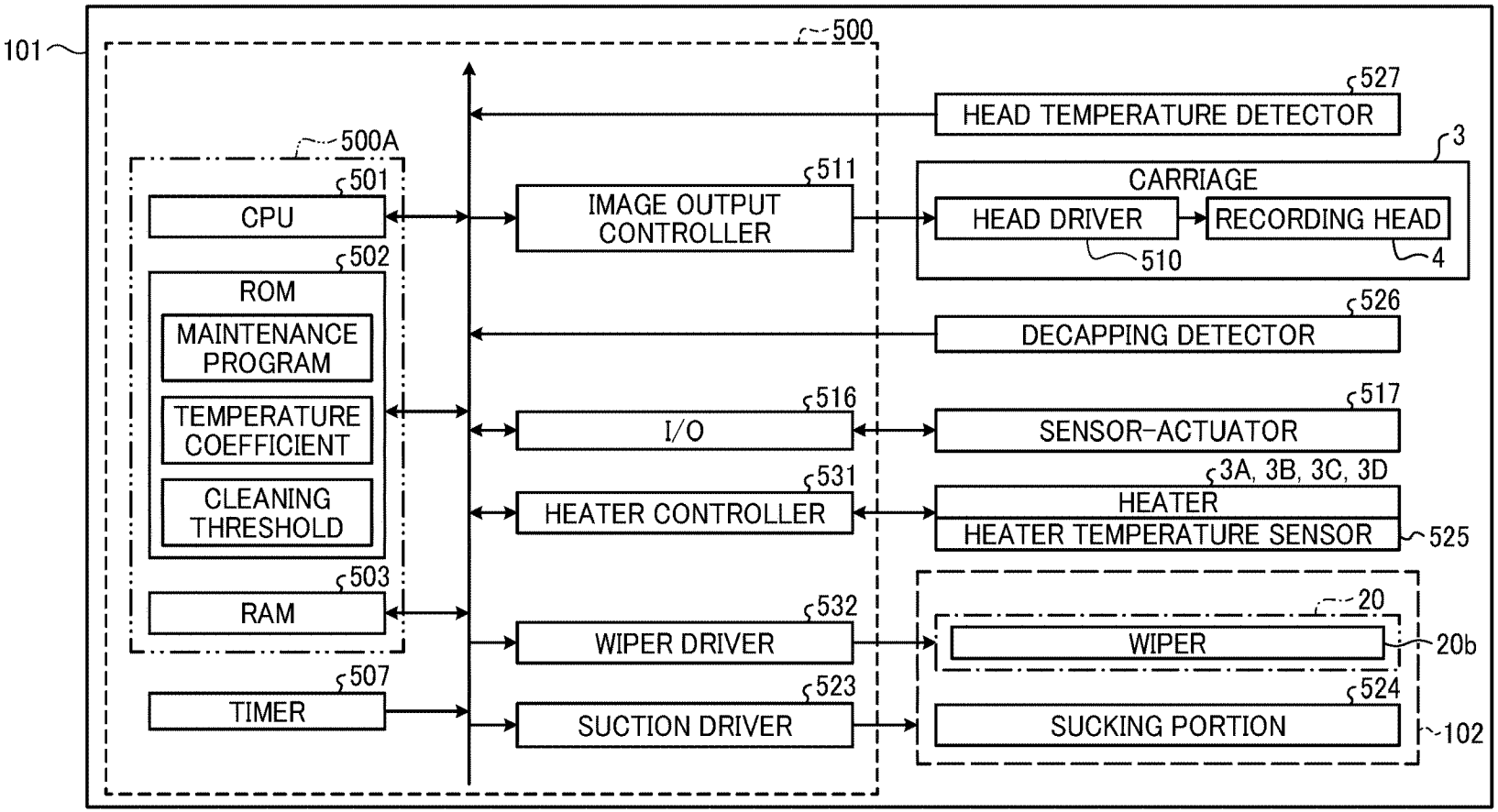
FIG. 4B is a block diagram of a maintenance device incorporated in the inkjet printer depicted in FIG. 4A.

FIG. 4A is a block diagram of the inkjet printer 100. FIG. 4B is a block diagram of a maintenance device 101 incorporated in the inkjet printer 100. As illustrated in FIG. 4A, the inkjet printer 100 includes a controller 500 that includes a main controller 500A including a central processing unit (CPU) 501, a read-only memory (ROM) 502, and a random-access memory (RAM) 503. The CPU 501 controls an entire operation of the inkjet printer 100. The ROM 502 stores programs executed by the CPU 501 and other fixed data. The RAM 503 temporarily stores image data and the like.

The controller 500 further includes a host interface (I/F) 506, an image output controller 511, and an encoder analyzer 512. The host I/F 506 mediates between a host device 600 and the inkjet printer 100 for data transfer. The host device 600 is an information processing device such as a personal computer (PC). The image output controller 511 controls driving of the recording heads 4. The encoder analyzer 512 analyzes detection signals from the main scanning encoder sensor 24 and the sub-scanning encoder sensor 26.

The controller 500 further includes a main scanning motor driver 513, a sub-scanning motor driver 514, and an input-output (I/O) device 516. The main scanning motor driver 513 drives the main scanning motor 5. The sub-scanning motor driver 514 drives the sub-scanning motor 16. The I/O device 516 communicates with a sensor-actuator 517 constructed of various sensors and actuators.

The image output controller 511 performs creation of print data, creation of a driving waveform that controls driving of the recording heads 4, transfer of a head control signal and print data, and the like. The head control signal selects a necessary driving signal from the driving waveform. The image output controller 511 supplies the driving waveform, the head control signal, the print data, and the like to a head driver 510 that drives the recording heads 4 mounted on the carriage 3. Thus, the nozzles 4*n* of the recording heads 4 discharge liquid according to the print data.

The encoder analyzer 512 includes a direction detector 520 and a counter 521. The direction detector 520 detects the moving direction of the carriage 3 based on a detection signal. The counter 521 detects a moving amount of the carriage 3.

The controller 500 controls driving of the main scanning motor 5 through the main scanning motor driver 513 based on an analysis result from the encoder analyzer 512, thus controlling motion of the carriage 3. The controller 500 controls driving of the sub-scanning motor 16 through the sub-scanning motor driver 514, thus controlling conveyance of the sheet 10.

The controller 500 further includes a suction driver 523 that controls suction of a sucking portion 524 that sucks ink from the nozzles 4*n* during cleaning of the recording heads 4. The controller 500 includes a heater controller 531 that controls driving of a first heater 3A, a second heater 3B, a third heater 3C, and a fan heater 3D described below with reference to FIG. 6. The heater controller 531 also obtains temperature detection information that indicates a current temperature of each of the first heater 3A, the second heater 3B, the third heater 3C, and the fan heater 3D, which is detected by a heater temperature sensor 525. The controller 500 further includes a wiper driver 532 that drives the wiper 20*b* of the maintenance-restoration mechanism 20. As illustrated in FIG. 4B, the wiper 20*b* and the sucking portion 524 construct a cleaner 102.

As illustrated in FIG. 4A, the inkjet printer 100 further includes a decapping detector 526 that detects a decapping state, that is, a printing state, in which the caps 20*a* do not cap or cover the recording heads 4, respectively. The controller 500 further includes a timer 507 that counts a continuous time that elapses since the caps 20*a* decap the recording heads 4, respectively.

The ROM 502 of the main controller 500A stores a maintenance program that performs a maintenance control (e.g., a cleaning control) of the recording heads 4 described below. The ROM 502 further stores a temperature coefficient determined based on the current temperature of each of the first heater 3A, the second heater 3B, the third heater 3C, and the fan heater 3D, which is detected by the heater temperature sensor 525, for example. The inkjet printer 100 according to the first embodiment provides a first cleaning and a second cleaning that have different cleaning processes, respectively, as types of cleaning of the recording heads 4. The controller 500 selects the first cleaning or the second cleaning based on a time calculated by multiplying a decapping time of the recording head 4 by the temperature coefficient. The ROM 502 stores a cleaning threshold, that is, a threshold for the decapping time, based on which the controller 500 selects the first cleaning or the second cleaning.

A description is provided of a functional configuration of the inkjet printer 100.

Figure 5:
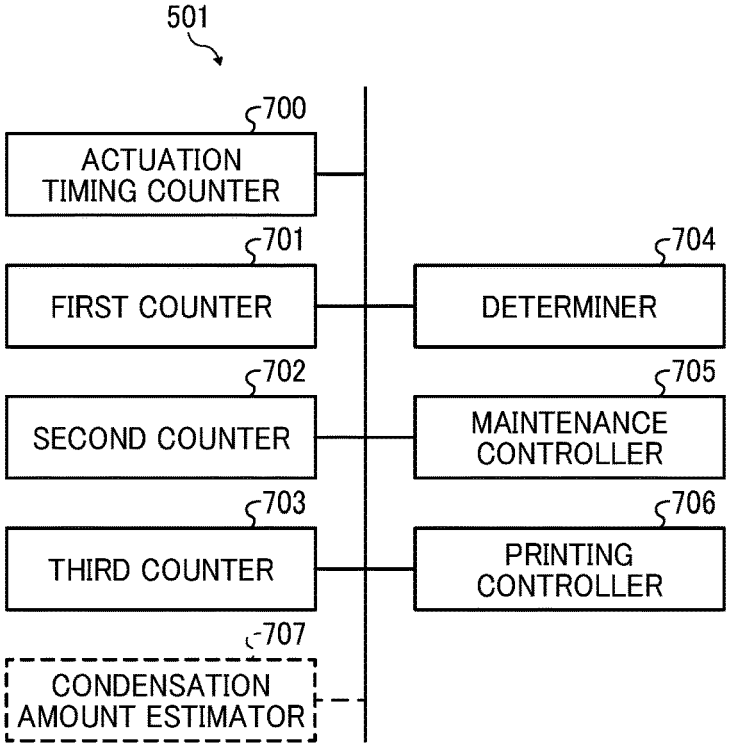
FIG. 5 is a functional block diagram of a central processing unit incorporated in the inkjet printer depicted in FIG. 4A.

FIG. 5 is a functional block diagram of a plurality of functions achieved by the CPU 501 that executes the maintenance program stored in the ROM 502. As illustrated in FIG. 5, the CPU 501 executes the maintenance program, thus functioning as an actuation timing counter 700, a first counter 701, a second counter 702, a third counter 703, a determiner 704, a maintenance controller 705, and a printing controller 706. As described below, the CPU 501 executes the maintenance program, thus also functioning as a condensation amount estimator 707.

The actuation timing counter 700 counts a predetermined time for 3 minutes, for example, during printing based on measurement information counted by the timer 507 depicted in FIG. 4A. As described below, the maintenance controller 705 controls a predetermined cleaning for a predetermined one of the recording heads 4 whenever the actuation timing counter 700 counts 3 minutes during printing. That is, in this example, a selected cleaning is performed on a selected one of the recording heads 4 every 3 minutes during printing. Alternatively, the actuation timing counter 700 may be hardware.

The first counter 701, the second counter 702, and the third counter 703 are disposed in the inkjet printer 100 according to the first embodiment that incorporates three recording heads 4, that is, a first recording head 4, a second recording head 4, and a third recording head 4 as one example. That is, a number of counters corresponds to a number of the recording heads 4. In the example illustrated in FIG. 5, the inkjet printer 100 incorporates three recording heads 4, that is, the first recording head 4, the second recording head 4, and the third recording head 4. Accordingly, the first counter 701, the second counter 702, and the third counter 703 are software. Alternatively, the first counter 701, the second counter 702, and the third counter 703 may be hardware.

Each of the first counter 701, the second counter 702, and the third counter 703 incorporates a first cleaning counter and a second cleaning counter.

The first cleaning counter of the first counter 701 counts a decapping time for which the cap 20*a* is removed from the first recording head 4. The second cleaning counter of the first counter 701 counts a decapping time for which the cap 20*a* is removed from the first recording head 4. The first cleaning counter and the second cleaning counter calculate multiplied times obtained by multiplying the decapping times by predetermined coefficients such as temperature coefficients described below, respectively. The multiplied times are added successively to obtain calculation times as a first cleaning off time for which the first cleaning is not performed on the first recording head 4 and a second cleaning off time for which the second cleaning is not performed on the first recording head 4, respectively. Similarly, the second counter 702 calculates a first cleaning off time for which the first cleaning is not performed on the second recording head 4 and a second cleaning off time for which the second cleaning is not performed on the second recording head 4. Similarly, the third counter 703 calculates a first cleaning off time for which the first cleaning is not performed on the third recording head 4 and a second cleaning off time for which the second cleaning is not performed on the third recording head 4.

Whenever the actuation timing counter 700 counts 3 minutes, for example, the determiner 704 compares each of the first cleaning off times for which the first cleaning is not performed, that are calculated by the first counter 701, the second counter 702, and the third counter 703, respectively, with a first cleaning threshold, that is, a threshold for the first cleaning. Further, the determiner 704 compares each of the second cleaning off times for which the second cleaning is not performed, that are calculated by the first counter 701, the second counter 702, and the third counter 703, respectively, with a second cleaning threshold, that is, a threshold for the second cleaning.

As one example, the first cleaning threshold is 9 minutes. As one example, the second cleaning threshold is 18 minutes. The determiner 704 determines whether or not 9 minutes as the first cleaning threshold have passed without the first cleaning on each of the recording heads 4. The determiner 704 determines whether or not 18 minutes as the second cleaning threshold have passed without the second cleaning on each of the recording heads 4. The determiner 704 sends determination results to the maintenance controller 705.

The maintenance controller 705 is one example of a cleaning controller. The maintenance controller 705 controls the wiper 20*b*, the sucking portion 524, and the like to perform the first cleaning or the second cleaning on one recording head 4 for which the determiner 704 determines that a time not shorter than the first cleaning threshold or the second cleaning threshold elapses. The printing controller 706 is one example of an interruption-resumption controller. The printing controller 706 performs a printing control such as an interruption control and a resumption control of printing before and after cleaning of the recording heads 4.

As described below, the condensation amount estimator 707 estimates a condensation amount of the recording head 4, that is, an amount of dew drops on the recording head 4, based on various factors. Each of the first counter 701, the second counter 702, and the third counter 703 multiplies the counted decapping time by the temperature coefficient and a coefficient corresponding to the condensation amount estimated by the condensation amount estimator 707, thus calculating the first cleaning off time for which the first cleaning is not performed and the second cleaning off time for which the second cleaning is not performed on each of the recording heads 4.

The inkjet printer 100 attains the first counter 701, the second counter 702, the third counter 703, and the condensation amount estimator 707 depicted in FIG. 5 with software, that is, the maintenance program. Alternatively, an entirety or a part of the first counter 701, the second counter 702, the third counter 703, and the condensation amount estimator 707 may be attained with hardware such as an integrated circuit (IC).

Alternatively, the maintenance program may be recorded in recording media, such as a compact disc read only memory (CD-ROM) and a flexible disk (FD), that are readable by a computer in a format installable or a file in a format executable. The maintenance program may be recorded in recording media, such as a compact disc-recordable (CD-R), a digital versatile disk (DVD), a Blu-Ray™ Disc, and a semiconductor memory, that are readable by a computer. The maintenance program may be available by installation via a network such as the Internet. The maintenance program may be available by preinstallation in a read-only memory (ROM) or the like incorporated in a device (e.g., the maintenance device 101).

A description is provided of condensation on the nozzle face of the recording head 4.

Figure 6:
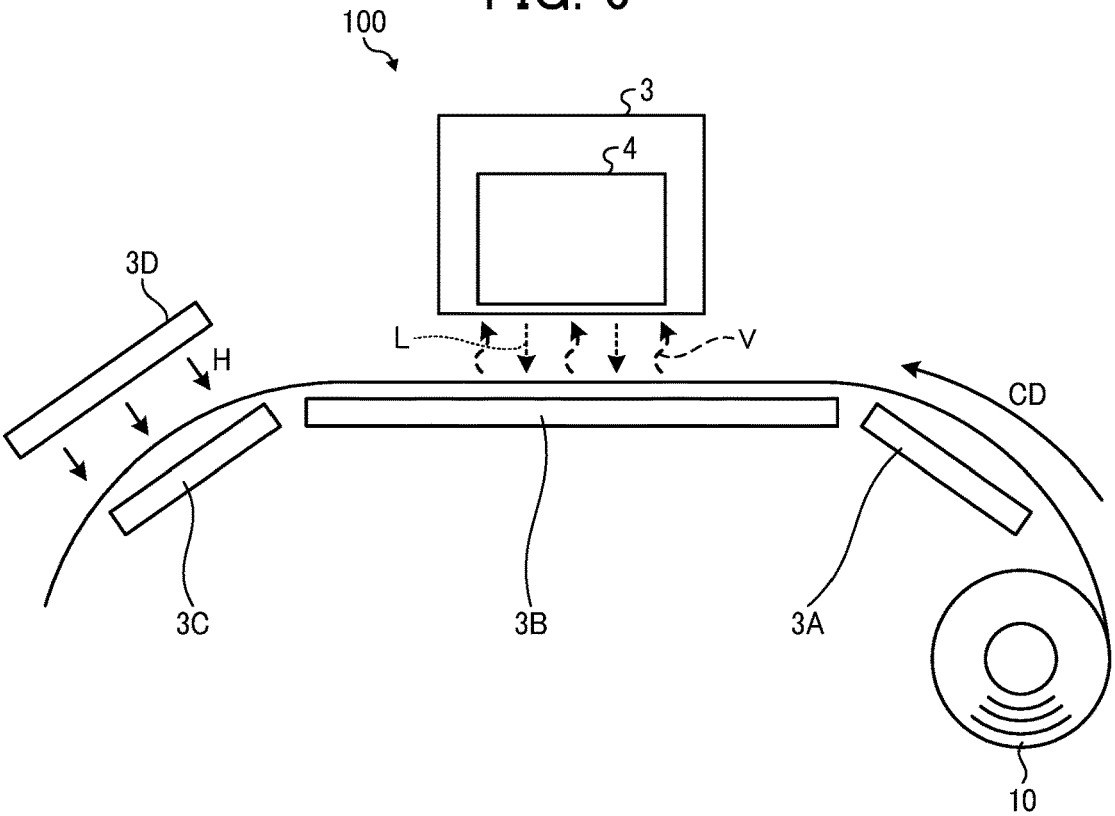
FIG. 6 is a diagram of the recording head depicted in FIG. 3, illustrating condensation that generates on a nozzle face of the recording head.

FIG. 6 is a diagram of the inkjet printer 100 according to the first embodiment, illustrating condensation that generates on the nozzle face of the recording head 4. As illustrated in FIG. 6, the inkjet printer 100 according to the first embodiment employs the first heater 3A, the second heater 3B, the third heater 3C, and the fan heater 3D to facilitate drying of ink on the sheet 10. Each of the first heater 3A, the second heater 3B, and the third heater 3C is a platen heater.

Ink (e.g., liquid droplets) discharged from the nozzle 4*n* of the recording head 4 in a direction L reaches the sheet 10 conveyed by the conveying belt 12 in a conveyance direction CD and is dried by heat from the first heater 3A, the second heater 3B, and the third heater 3C. The fan heater 3D sends hot air H onto the sheet 10. Vapor of ink, that generates during drying, travels in a direction V and causes condensation on the nozzle face of the recording head 4. As printing continues, the condensation amount on the nozzle face of the recording head 4 increases, resulting in faulty discharging from the recording head 4 due to condensation. In order to prevent faulty discharging, the inkjet printer 100 need to remove dew drops periodically during printing.

A description is provided of a configuration of a comparative inkjet recording apparatus designed to achieve stability in continuous recording and intermittent recording.

The comparative inkjet recording apparatus performs a first cleaning in which a nozzle of a print head discharges ink for inkjet recording into an ink receiver such that the ink does not perform recording on a recording medium. Thus, the nozzle and a nozzle face of the print head are cleaned. Additionally, the comparative inkjet recording apparatus performs a second cleaning in which the print head moves to the ink receiver and the nozzle of the print head discharges ink for inkjet recording into the ink receiver such that the ink does not perform recording on a recording medium. Thus, the nozzle of the print head is cleaned. The second cleaning is performed under a condition in which an amount of ink discharged not to perform recording on the recording medium is smaller than that in the first cleaning and the ink is discharged more frequently than in the first cleaning.

The comparative inkjet recording apparatus detects usage and clogging of the nozzle and selects the first cleaning or the second cleaning properly. Thus, the comparative inkjet recording apparatus achieves stability in continuous recording and intermittent recording.

However, if the comparative inkjet recording apparatus includes a plurality of print heads, removal of dew drops from the nozzle face is performed successively for an entirety of the plurality of print heads. Hence, printing is interrupted until cleaning of the entirety of the plurality of print heads is finished. While printing is interrupted, drying of ink above the platen heater may fluctuate, causing uneven density of ink on a print before and after cleaning.

A description is provided of types of cleaning.

Figure 7A:
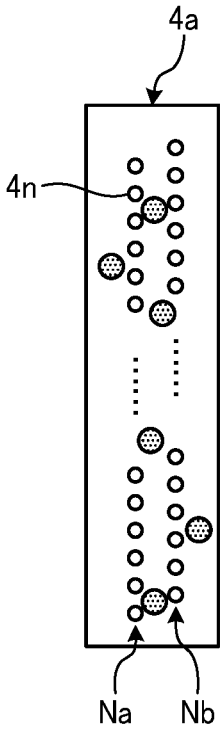
FIG. 7A is a diagram of the recording head depicted in FIG. 3, illustrating dew drops adhered to the recording head.
Figure 7B:
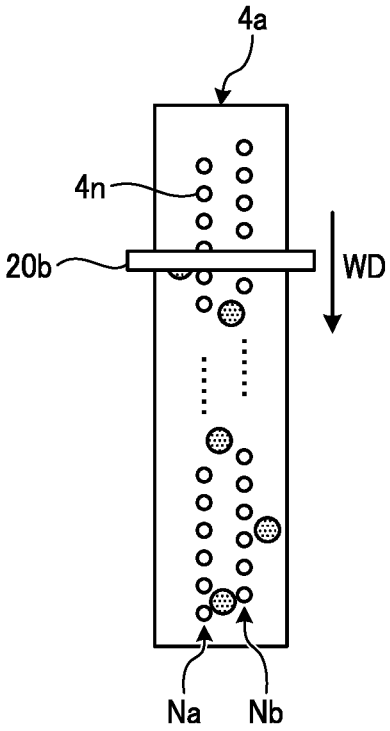
FIG. 7B is a diagram of the recording head depicted in FIG. 7A, illustrating a wiping process of a first cleaning that cleans the recording head.
Figure 7C:
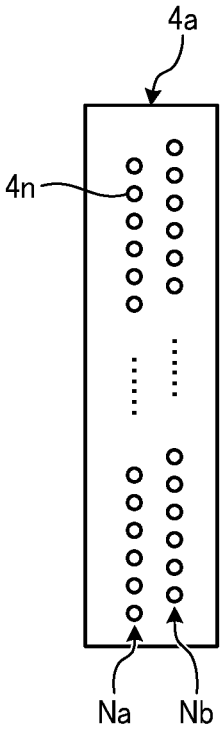
FIG. 7C is a diagram of the recording head depicted in FIG. 7A, illustrating a dummy discharging process of the first cleaning.

The inkjet printer 100 according to the first embodiment provides two types of cleaning for cleaning the recording head 4. FIGS. 7A, 7B, and 7C illustrate processes of the first cleaning. FIGS. 8A, 8B, 8C, and 8D illustrate processes of the second cleaning.

As illustrated in FIG. 7B, the first cleaning includes a wiping process in which the wiper 20*b* moves in a wiping direction WD and wipes the recording head 4*a* adhered with dew drops. As illustrated in FIG. 7C, the first cleaning further includes a dummy discharging process in which each of the nozzles 4*n* discharges ink into the cap 20*a*, an ink receiver exclusively used, or the like after the wiper 20*b* wipes the recording head 4*a* and removes the dew drops.

If the first cleaning is selected, the wiping process and the dummy discharging process are performed on the recording head 4*a* successively. The first cleaning omits a sucking process of the second cleaning described below. Accordingly, the first cleaning takes a shorter time than the second cleaning.

Figure 8A:
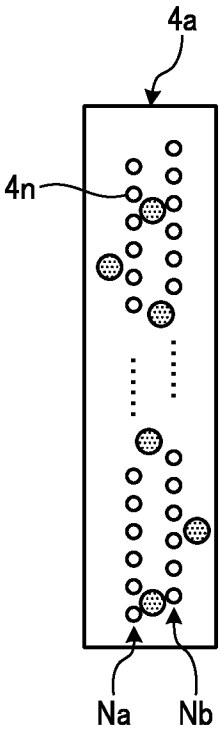
FIG. 8A is a diagram of the recording head depicted in FIG. 3, illustrating dew drops adhered to the recording head.
Figure 8B:
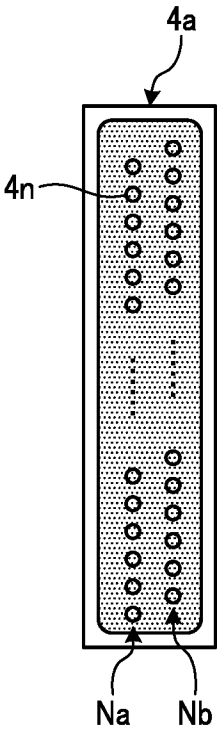
FIG. 8B is a diagram of the recording head depicted in FIG. 8A, illustrating a sucking process of a second cleaning that cleans the recording head.
Figure 8C:
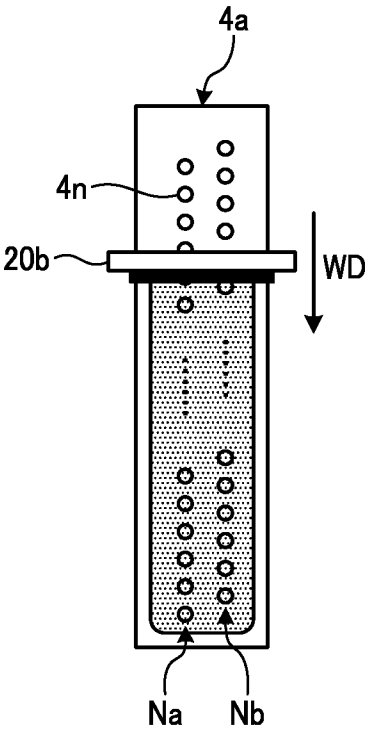
FIG. 8C is a diagram of the recording head depicted in FIG. 8A, illustrating a wiping process of the second cleaning that cleans the recording head.
Figure 8D:
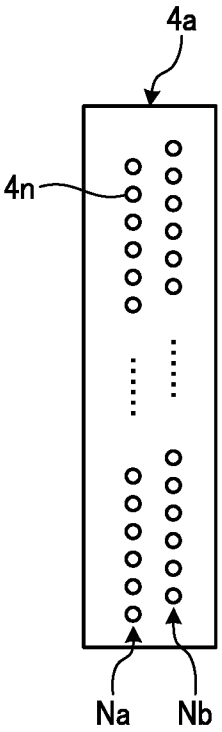
FIG. 8D is a diagram of the recording head depicted in FIG. 8A, illustrating a dummy discharging process of the second cleaning.

Conversely, as illustrated in FIG. 8B, the second cleaning includes the sucking process in which the sucking portion 524 sucks dew drops adhered to the recording head 4*a* as illustrated in FIG. 8A from the nozzles 4*n* of the recording head 4*a*, thus cleaning the recording head 4*a*. As illustrated in FIG. 8C, the second cleaning further includes the wiping process in which the wiper 20*b* wipes the recording head 4*a* after the sucking process. As illustrated in FIG. 8D, the second cleaning further includes the dummy discharging process in which each of the nozzles 4*n* discharges ink into the cap 20*a*, the ink receiver exclusively used, or the like after the wiper 20*b* wipes the recording head 4*a* and removes the dew drops.

If the second cleaning is selected, the sucking process, the wiping process, and the dummy discharging process are performed on the recording head 4*a* successively. Since the second cleaning includes the sucking process, the second cleaning takes a longer time than the first cleaning. However, the second cleaning removes the dew drops from the recording head 4*a* with an improved cleaning grade compared to the first cleaning.

A description is provided of determination of a cleaning time.

A description is now given of conditions of cleaning of the recording head 4 during printing.

The condensation amount of dew drops adhered to the nozzle face of the recording head 4 increases as an ink discharging time (e.g., a printing time) increases. The condensation amount increases as a temperature difference between a temperature of each of the first heater 3A, the second heater 3B, the third heater 3C, and the fan heater 3D and a temperature of the recording head 4 increases. Accordingly, the first cleaning counter and the second cleaning counter of each of the first counter 701, the second counter 702, and the third counter 703 use formula 1 below to calculate the first cleaning off time for which the first cleaning is not performed on each of the recording heads 4 and the second cleaning off time for which the second cleaning is not performed on each of the recording heads 4. The first cleaning off time and the second cleaning off time may be hereinafter referred to as a cleaning off time collectively.

$$t1=\Sigma(TC\times t2) \quad 1$$

In formula 1, t1 represents the cleaning off time in seconds. TC represents the temperature coefficient. t2 represents the decapping time in seconds.

The decapping time indicates a continuous time that elapses continuously after the cap 20*a* is removed from the recording head 4. The cap 20*a* serving as a cover covers the recording head 4 while printing is not performed to prevent the recording head 4 from being dried. That is, the decapping time indicates a continuous time that elapses after printing starts. The decapping detector 526 depicted in FIG. 4A detects a decapping state in which the cap 20*a* is removed from the recording head 4 and notifies the decapping state to the CPU 501. The CPU 501 (e.g., the first counter 701, the second counter 702, and the third counter 703) starts counting timekeeping information from the timer 507 at a time when the CPU 501 is notified of the decapping state of the recording head 4.

As illustrated in a temperature table as table 1 below, the temperature coefficient is determined based on temperatures of the first heater 3A, the second heater 3B, the third heater 3C, and the fan heater 3D, that are detected by the heater temperature sensor 525, and a temperature of the recording head 4, that is detected by a head temperature detector 527. As the temperature difference between the temperature of each of the first heater 3A, the second heater 3B, the third heater 3C, and the fan heater 3D and the temperature of the recording head 4 increases, a value of the temperature coefficient increases. Table 1 illustrates the temperature coefficient that increases from E to A. E is smaller than D. D is smaller than C. C is smaller than B. B is smaller than A. E is the smallest temperature coefficient and A is the greatest temperature coefficient.

TABLE 1

| Temperature coefficient | | Temperature of recording head: Lower than 20° C. | Not lower than 20° C. and lower than 40° C. | Not lower than 40° C. |
|---|---|---|---|---|
| Temperature of heater | Lower than 40° C. | C | D | E |
| | Not lower than 40° C. and lower than 60° C. | B | C | D |
| | Not lower than 60° C. | A | B | C |

In table 1, the heater represents the first heater 3A, the second heater 3B, the third heater 3C, or the fan heater 3D. The recording head represents the recording head 4.

The CPU 501, during the decapping time of each of the recording heads 4, performs calculation of multiplying the decapping time by the temperature coefficient determined based on the temperature of the first heater 3A, the second heater 3B, the third heater 3C, or the fan heater 3D and the temperature of the recording head 4, and summing up, thus calculating the first cleaning off time for which the first cleaning is not performed on each of the recording heads 4 and the second cleaning off time for which the second cleaning is not performed on each of the recording heads 4. The CPU 501 performs the first cleaning on the recording head 4 for which the cleaning off time for which the first cleaning and the second cleaning are not performed is not smaller than the first cleaning threshold. The CPU 501 performs the second cleaning on the recording head 4 for which the cleaning off time for which the first cleaning and the second cleaning are not performed is not smaller than the second cleaning threshold.

The condensation amount increases as the temperature difference between the temperature of each of the first heater 3A, the second heater 3B, the third heater 3C, and the fan heater 3D and the temperature of the recording head 4 increases. As illustrated in table 1, as the temperature difference between the temperature of each of the first heater 3A, the second heater 3B, the third heater 3C, and the fan heater 3D and the temperature of the recording head 4 increases, the temperature coefficient used for the calculation described above increases. Accordingly, as the temperature difference between the temperature of each of the first heater 3A, the second heater 3B, the third heater 3C, and the fan heater 3D and the temperature of the recording head 4 increases, the cleaning off time that is calculated increases and reaches the first cleaning threshold or the second cleaning threshold quickly. Thus, the CPU 501 performs cleaning of the recording head 4 to remove dew drops from the recording head 4 frequently.

A description is provided of cleaning timing of each of the recording heads 4 based on the temperature coefficient.

Figure 9:
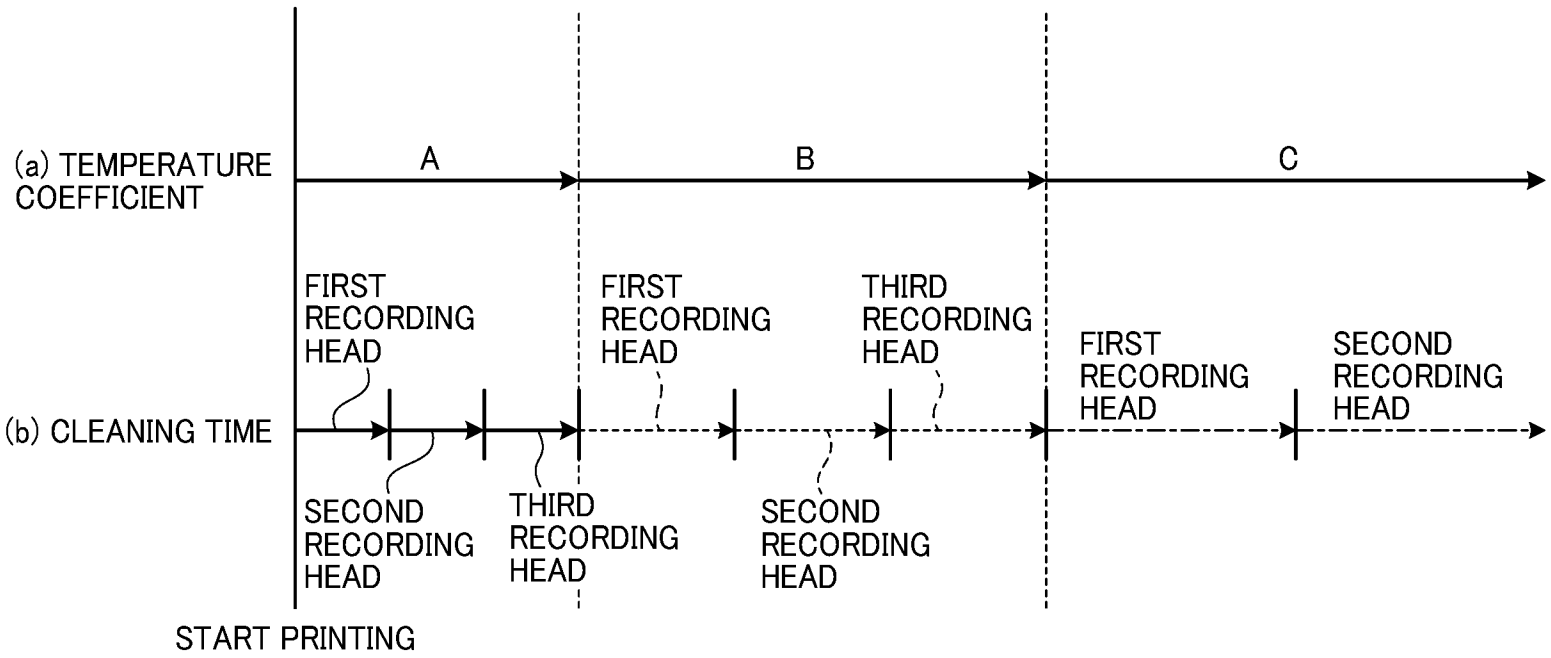
FIG. 9 is a timing chart illustrating cleaning timing of a plurality of recording heads incorporated in the inkjet printer depicted in FIG. 4A based on a temperature coefficient.

FIG. 9 is a timing chart illustrating cleaning timing of each of the recording heads 4 based on the temperature coefficient. Section (a) in FIG. 9 illustrates transition of the temperature coefficient according to change in the temperature of each of the first heater 3A, the second heater 3B, the third heater 3C, and the fan heater 3D and the temperature of each of the recording heads 4. Section (b) in FIG. 9 illustrates a cycle of cleaning (e.g., a cleaning time) of each of the recording heads 4. The cleaning time defines a time when the cleaning off time reaches the first cleaning threshold or the second cleaning threshold.

As illustrated in FIG. 9, based on the temperature of each of the first heater 3A, the second heater 3B, the third heater 3C, and the fan heater 3D and the temperature of each of the recording heads 4, that are detected when printing starts, the CPU 501 determines that the temperature difference between the temperature of each of the first heater 3A, the second heater 3B, the third heater 3C, and the fan heater 3D and the temperature of each of the recording heads 4 is substantial and selects A as the temperature coefficient in table 1. In this case, the CPU 501 multiplies the cleaning off time of each of the recording heads 4 by a substantial value as the temperature coefficient. Hence, the cleaning off time of each of the recording heads 4 reaches the first cleaning threshold or the like quickly. Accordingly, the recording heads 4 are cleaned with a shortened cycle.

As printing continues and the temperature of each of the recording heads 4 increases, for example, the temperature coefficient that is selected changes to smaller values gradually from A to B and from B to C, for example. If the temperature coefficient changes to B, the CPU 501 multiplies the decapping time of each of the recording heads 4 by B as the temperature coefficient that is smaller than A. Thus, the cycle of cleaning of each of the recording heads 4 with B as the temperature coefficient is longer than that with A as the temperature coefficient. Similarly, if the temperature coefficient changes to C, the CPU 501 multiplies the decapping time of each of the recording heads 4 by C as the temperature coefficient that is even smaller than B. Thus, the cycle of cleaning of each of the recording heads 4 with C as the temperature coefficient is even longer than that with B as the temperature coefficient.

The CPU 501 switches the temperature coefficient when cleaning of an entirety of the recording heads 4 based on the selected temperature coefficient is completed. For example, the CPU 501 switches the temperature coefficient from A to B after cleaning of the first recording head 4, the second recording head 4, and the third recording head 4 with A as the temperature coefficient is completed, as illustrated in section (b) in FIG. 9. Similarly, the CPU 501 switches the temperature coefficient from B to C after cleaning of the first recording head 4, the second recording head 4, and the third recording head 4 with B as the temperature coefficient is completed, as illustrated in section (b) in FIG. 9.

A description is provided of selection of the recording head 4 to be cleaned.

The inkjet printer 100 according to the first embodiment does not clean the plurality of recording heads 4 simultaneously during printing, that is, does clean the plurality of recording heads 4 with a time lag, thus shortening a time taken for a single cleaning and suppressing uneven density of an image formed on the sheet 10.

The inkjet printer 100 according to the first embodiment cleans the recording heads 4 one by one in an order in which the recording head 4 for which the cleaning off time, that is obtained by multiplying the temperature coefficient by the decapping time in seconds, reaches a threshold (e.g., the first cleaning threshold or the second cleaning threshold), is cleaned earlier. The inkjet printer 100 does not clean the plurality of recording heads 4 simultaneously. If the condensation amounts of the plurality of recording heads 4 reach the threshold simultaneously, as illustrated in table 2 below, the inkjet printer 100 cleans the recording heads 4 one by one according to a predetermined order of priority of the recording heads 4.

TABLE 2

| | First recording head | Second recording head | Third recording head |
|---|---|---|---|
| First cleaning | 4 | 5 | 6 |
| Second cleaning | 1 | 2 | 3 |

Table 2 illustrates an example of the order of priority of the recording heads 4, the first cleaning, and the second cleaning. The second cleaning includes the sucking process that is not included in the first cleaning. Hence, the second cleaning attains the improved cleaning grade compared to the first cleaning. The example illustrated in table 2 indicates, for each head (first recording head through third recording head) that the second cleaning has a priority over the first cleaning. That is, a priority given to the second cleaning—priority "1," the highest priority, for the first recording head, priority "2" for the second recording head, and priority "3" for the third recording head)—is higher than a priority given to the first cleaning for each head—priority "4" for the first cleaning approach for the first recording head, priority "2" for the first cleaning approach for the second recording head, and priority "6," the lowest priority, for the first cleaning approach for the third recording head. The example illustrated in table 2 also indicates that a priority given to the first recording head 4, i.e., "1" for the second cleaning approach and "4" for the first cleaning approach, is higher than a priority given to the second recording head 4, i.e., "2" for the second cleaning approach and "5" for the first cleaning approach. The priority given to the second recording head 4 is higher than a priority given to the third recording head 4, i.e., "3" for the second cleaning approach and "6" for the first cleaning approach.

Accordingly, the inkjet printer 100 performs the first cleaning or the second cleaning on the recording heads 4 with a first priority given to the second cleaning on the first recording head 4, that is higher than a second priority given to the second cleaning on the second recording head 4, that is higher than a third priority given to the second cleaning on the third recording head 4, that is higher than a fourth priority given to the first cleaning on the first recording head 4, that is higher than a fifth priority given to the first cleaning on the second recording head 4, that is higher than a sixth priority given to the first cleaning on the third recording head 4.

The maintenance controller 705 depicted in FIG. 5 controls cleaning according to conditions below to select a head to be cleaned based on counters associated with each head and based on the above preset priorities (as similarly described below in FIG. 11).

As a first condition, the maintenance controller 705 controls the cleaner 102 to clean the recording head 4 for which a count value counted by the counter (e.g., the first counter 701, the second counter 702, or the third counter 703) exceeds the threshold (e.g., the first cleaning threshold or the second cleaning threshold).

As a second condition, if no count value exceeds the threshold, the maintenance controller 705 controls the cleaner 102 to clean the recording head 4 for which a count value counted by the counter is closest to the threshold.

As a third condition, if two or more recording heads 4 have count values that are counted by the counters, respectively, and exceed the threshold, or if no count value exceeds the threshold and two or more recording heads 4 have count values that are counted by the counters, respectively, and are closest to the threshold, the maintenance controller 705 controls the cleaner 102 to clean the recording heads 4 based on the order of priority preset according to the type of cleaning (e.g., the first cleaning or the second cleaning), that is, the order of priority preset for each of the first cleaning and the second cleaning.

As a fourth condition, if two or more recording heads 4 have count values that are counted by the counters, respectively, and are applied to the first condition, the second condition, and the third condition, the maintenance controller 705 controls the cleaner 102 to clean the recording head 4 for which a count value counted by the counter is greatest.

As a fifth condition, if two or more recording heads 4 have count values that are counted by the counters, respectively, and are applied to the first condition, the second condition, the third condition, and the fourth condition, the maintenance controller 705 controls the cleaner 102 to clean the recording heads 4 based on the order of priority for the recording heads 4, that is, the order of priority preset for each of the recording heads 4.

As an example, the inkjet printer 100 incorporates three recording heads 4 and provides two types of cleaning, that is, the first cleaning and the second cleaning. As the order of priority for the recording heads 4, the priority given to the first recording head 4 is higher than the priority given to the second recording head 4. The priority given to the second recording head 4 is higher than the priority given to the third recording head 4. As the order of priority for the type of cleaning, the priority given to the second cleaning is higher than the priority given to the first cleaning.

As the threshold for selecting the type of cleaning, the first cleaning threshold and the second cleaning threshold are provided. The first cleaning threshold is a first threshold based on which the CPU 501 determines whether or not to perform the first cleaning as described with reference to FIGS. 7A, 7B, and 7C. The second cleaning threshold is a second threshold based on which the CPU 501 determines whether or not to perform the second cleaning as described with reference to FIGS. 8A, 8B, 8C, and 8D.

Figure 10:
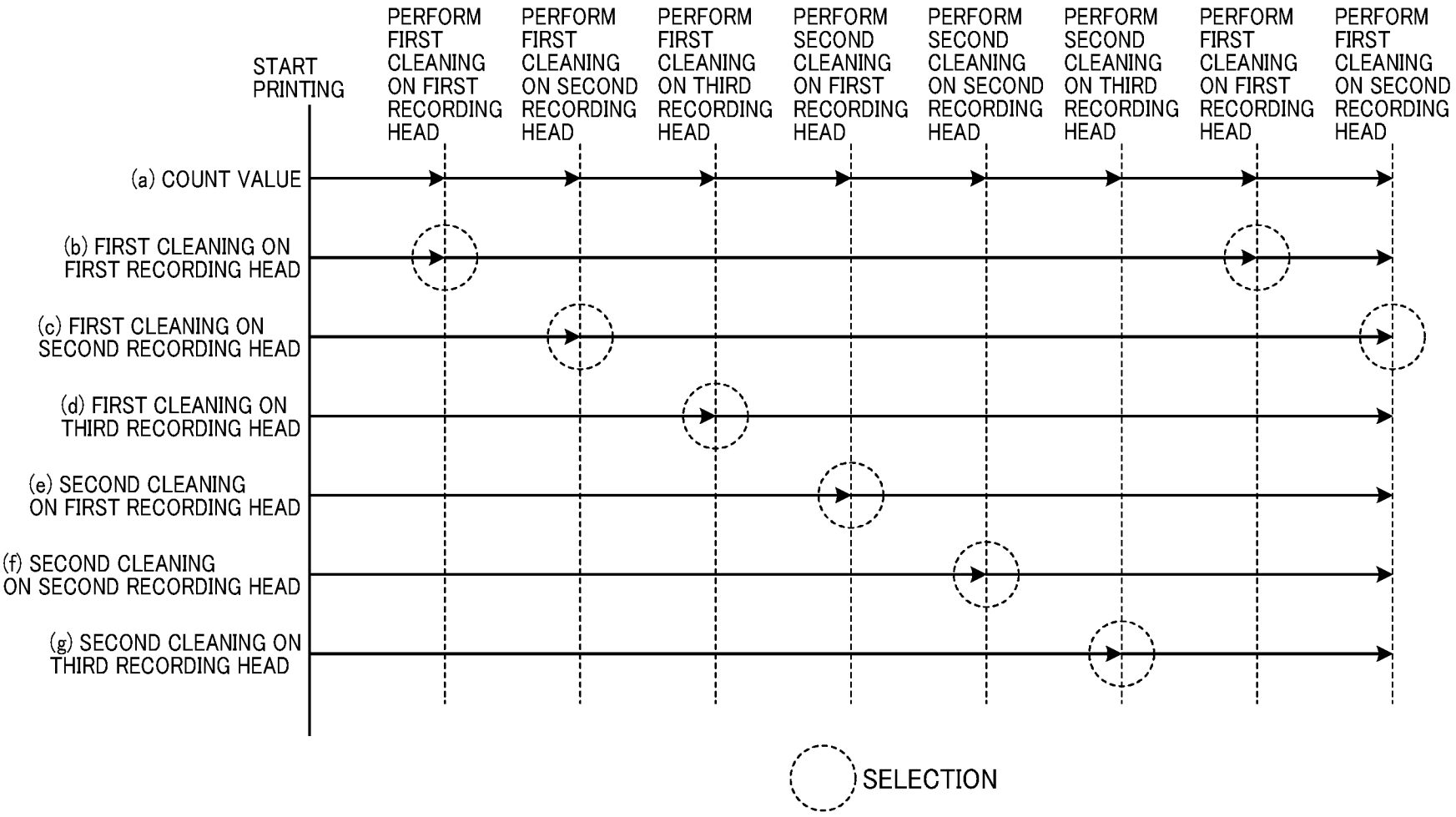
FIG. 10 is a timing chart illustrating timing of the first cleaning and the second cleaning performed on each of the recording heads incorporated in the inkjet printer depicted in FIG. 4A.

The CPU 501 determines whether or not to clean the recording head 4 and cleans the recording head 4 whenever the actuation timing counter 700 depicted in FIG. 5 counts 3 minutes, for example. FIG. 10 illustrates, in section (a), periods of time of 3 minutes with arrows. Whenever the actuation timing counter 700 counts 3 minutes, for example, the CPU 501 determines whether or not to clean the recording head 4 and cleans the recording head 4.

For example, when the actuation timing counter 700 counts 3 minutes after printing starts, the determiner 704 depicted in FIG. 5 determines whether or not the first cleaning off time for which the first cleaning is not performed is not smaller than the first cleaning threshold. The first cleaning off time is calculated by the first cleaning counter of the first counter 701 for the first recording head 4. If the determiner 704 determines that the first cleaning off time that is calculated is not smaller than the first cleaning threshold, the maintenance controller 705 controls elements for performing the first cleaning (e.g., the wiper driver 532, the wiper 20*b*, the head driver 510, and the recording head 4) to perform the first cleaning on the first recording head 4 as illustrated in section (b) in FIG. 10.

Subsequently, when the actuation timing counter 700 counts another 3 minutes, the determiner 704 determines whether or not the first cleaning off time for which the first cleaning is not performed is not smaller than the first cleaning threshold. The first cleaning off time is calculated by the first cleaning counter of the second counter 702 for the second recording head 4. If the determiner 704 determines that the first cleaning off time that is calculated is not smaller than the first cleaning threshold, the maintenance controller 705 controls the elements for performing the first cleaning (e.g., the wiper driver 532, the wiper 20*b*, the head driver 510, and the recording head 4) to perform the first cleaning on the second recording head 4 as illustrated in section (c) in FIG. 10.

Subsequently, when the actuation timing counter 700 counts another 3 minutes, the determiner 704 determines whether or not the first cleaning off time for which the first cleaning is not performed is not smaller than the first cleaning threshold. The first cleaning off time is calculated by the first cleaning counter of the third counter 703 for the third recording head 4. If the determiner 704 determines that the first cleaning off time that is calculated is not smaller than the first cleaning threshold, the maintenance controller 705 controls the elements for performing the first cleaning (e.g., the wiper driver 532, the wiper 20*b*, the head driver 510, and the recording head 4) to perform the first cleaning on the third recording head 4 as illustrated in section (d) in FIG. 10.

Subsequently, when the actuation timing counter 700 counts another 3 minutes, the determiner 704 determines whether or not the second cleaning off time for which the second cleaning is not performed is not smaller than the second cleaning threshold. The second cleaning off time is calculated by the second cleaning counter of the first counter 701 for the first recording head 4. If the determiner 704 determines that the second cleaning off time that is calculated is not smaller than the second cleaning threshold, the maintenance controller 705 controls elements for performing the second cleaning (e.g., the suction driver 523, the sucking portion 524, the wiper driver 532, the wiper 20*b*, the head driver 510, and the recording head 4) to perform the second cleaning on the first recording head 4 as illustrated in section (e) in FIG. 10.

Subsequently, when the actuation timing counter 700 counts another 3 minutes, the determiner 704 determines whether or not the second cleaning off time for which the second cleaning is not performed is not smaller than the second cleaning threshold. The second cleaning off time is calculated by the second cleaning counter of the second counter 702 for the second recording head 4. If the determiner 704 determines that the second cleaning off time that is calculated is not smaller than the second cleaning threshold, the maintenance controller 705 controls the elements for performing the second cleaning (e.g., the suction driver 523, the sucking portion 524, the wiper driver 532, the wiper 20*b*, the head driver 510, and the recording head 4) to perform the second cleaning on the second recording head 4 as illustrated in section (f) in FIG. 10.

Subsequently, when the actuation timing counter 700 counts another 3 minutes, the determiner 704 determines whether or not the second cleaning off time for which the second cleaning is not performed is not smaller than the second cleaning threshold. The second cleaning off time is calculated by the second cleaning counter of the third counter 703 for the third recording head 4. If the determiner 704 determines that the second cleaning off time that is calculated is not smaller than the second cleaning threshold, the maintenance controller 705 controls the elements for performing the second cleaning (e.g., the suction driver 523, the sucking portion 524, the wiper driver 532, the wiper 20*b*, the head driver 510, and the recording head 4) to perform the second cleaning on the third recording head 4 as illustrated in section (g) in FIG. 10.

When cleaning is finished, the first cleaning counter and the second cleaning counter of each of the first counter 701, the second counter 702, and the third counter 703 reset the count values, respectively.

For example, even if cleaning is performed by an arbitrary operation or the like of a user, the first cleaning counter and the second cleaning counter reset the count values, respectively. The second cleaning includes more processes than the first cleaning, thus serving as a superior maintenance compared to the first cleaning. Hence, when the second cleaning is finished, both the first cleaning counter and the second cleaning counter reset the count values, respectively.

When the first cleaning or the second cleaning is finished, the actuation timing counter 700 resets the count value. Hence, as illustrated in section (a) in FIG. 10, the determiner 704 determines the recording head 4 to be cleaned every 3 minutes, for example, and the recording head 4 is cleaned.

A service engineer or a user may arbitrarily change the first cleaning threshold and the second cleaning threshold so as to change a cycle of the first cleaning and the second cleaning and an order of the first cleaning and the second cleaning. For example, after the first cleaning is performed twice, the second cleaning may be performed.

A description is provided of cleaning processes.

Figure 11:
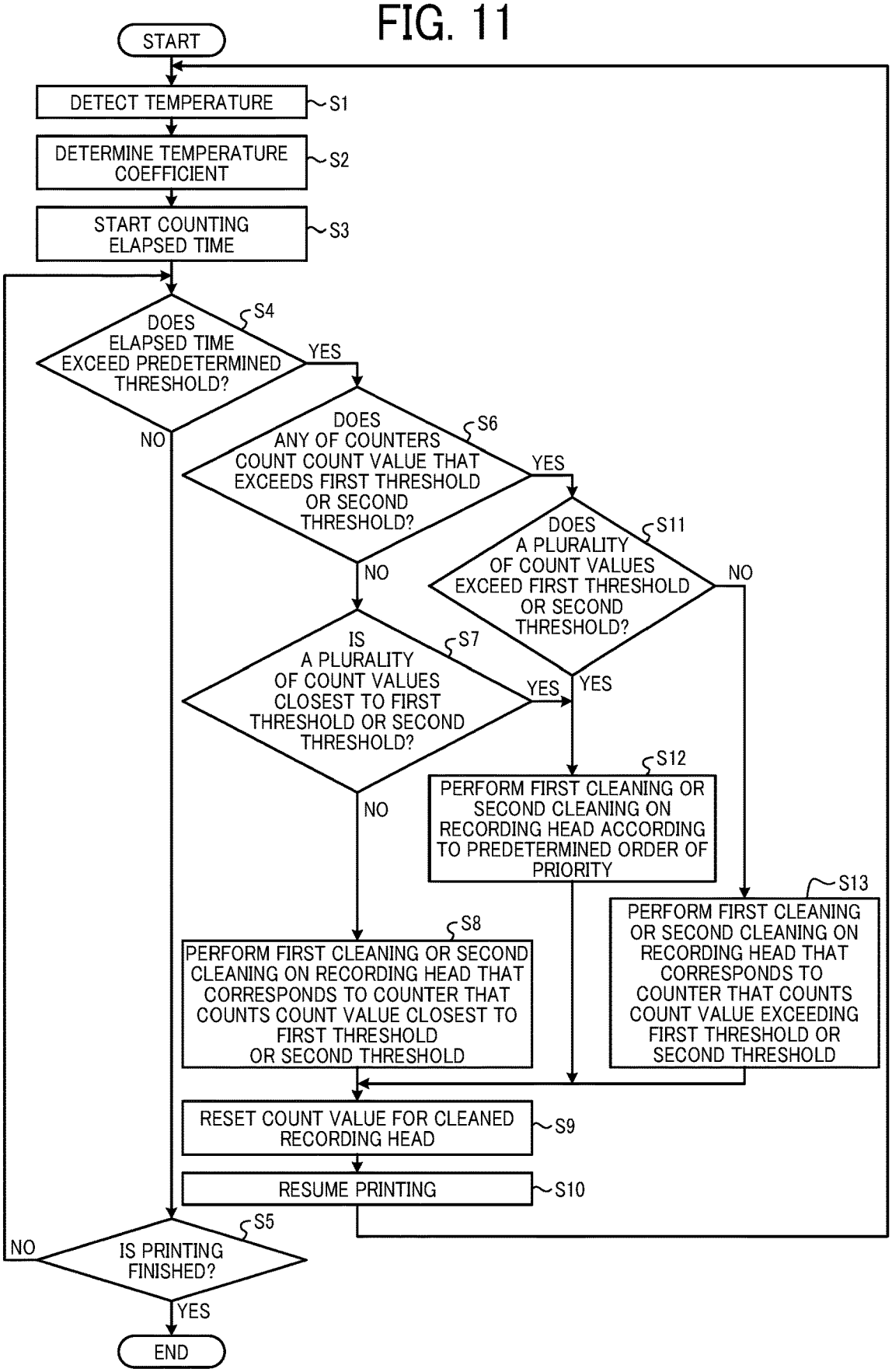
FIG. 11 is a flowchart illustrating processes of the first cleaning and the second cleaning performed by the inkjet printer depicted in FIG. 4A.

With reference to FIG. 11 illustrating a flowchart of the cleaning processes, a description is provided of the cleaning processes for cleaning the recording heads 4 performed by the inkjet printer 100 according to the first embodiment.

In step S1, when printing (e.g., a print job) starts, the heater temperature sensor 525 depicted in FIG. 4A detects a temperature of each of the first heater 3A, the second heater 3B, the third heater 3C, and the fan heater 3D and the head temperature detector 527 depicted in FIG. 4A detects a temperature of each of the recording heads 4. Alternatively, the heater temperature sensor 525 may detect the temperature of the second heater 3B that heats the sheet 10 so as to evaporate moisture of ink mainly.

In step S2, the determiner 704 determines a temperature coefficient based on the temperature difference between the temperature of each of the first heater 3A, the second heater 3B, the third heater 3C, and the fan heater 3D and the temperature of each of the recording heads 4 as described above with reference to table 1.

In step S3, the actuation timing counter 700 starts counting an elapsed time at a time when printing starts as a trigger.

In step S4, the actuation timing counter 700 determines whether or not the elapsed time counted exceeds a predetermined threshold of 3 minutes, for example. Before the actuation timing counter 700 determines that the elapsed time exceeds the predetermined threshold (NO in step S4), the actuation timing counter 700 repeats step S4 through step S5 in which the actuation timing counter 700 determines whether or not printing is finished.

If the actuation timing counter 700 determines that the elapsed time exceeds the predetermined threshold, the actuation timing counter 700 resets the count value and resumes counting an elapsed time. If the actuation timing counter 700 determines that the elapsed time exceeds the predetermined threshold, the cleaning processes start as described below. Hence, if 3 minutes are defined as the predetermined threshold, for example, the cleaning processes described below are performed every 3 minutes.

If the actuation timing counter 700 determines that the elapsed time exceeds the predetermined threshold (YES in step S4), step S6 starts. The determiner 704 refers to count values of the first cleaning counter and the second cleaning counter of each of the first counter 701, the second counter 702, and the third counter 703 for the first recording head 4, the second recording head 4, and the third recording head 4, respectively.

In step S6, the determiner 704 determines whether or not any of the first cleaning counters counts a count value that exceeds the first cleaning threshold or any of the second cleaning counters counts a count value that exceeds the second cleaning threshold.

If the determiner 704 determines that any of the first cleaning counters counts the count value that exceeds the first cleaning threshold and any of the second cleaning counters counts the count value that exceeds the second cleaning threshold (YES in step S6), step S11 starts.

In step S11, the determiner 704 determines whether or not a plurality of first cleaning counters counts the count value that exceeds the first cleaning threshold or a plurality of second cleaning counters counts the count value that exceeds the second cleaning threshold.

If the determiner 704 determines that a single first cleaning counter counts the count value that exceeds the first cleaning threshold or a single second cleaning counter counts the count value that exceeds the second cleaning threshold (NO in step S11), step S13 starts.

In step S13, the maintenance controller 705 controls the elements for performing the first cleaning (e.g., the wiper driver 532, the wiper 20*b*, the head driver 510, and the recording head 4) to perform the first cleaning on the recording head 4 that corresponds to the first cleaning counter that counts the count value exceeding the first cleaning threshold. Alternatively, the maintenance controller 705 controls the elements for performing the second cleaning (e.g., the suction driver 523, the sucking portion 524, the wiper driver 532, the wiper 20*b*, the head driver 510, and the recording head 4) to perform the second cleaning on the recording head 4 that corresponds to the second cleaning counter that counts the count value exceeding the second cleaning threshold. Accordingly, step S9 starts.

Conversely, if the determiner 704 determines that the plurality of first cleaning counters counts the count value that exceeds the first cleaning threshold or the plurality of second cleaning counters counts the count value that exceeds the second cleaning threshold (YES in step S11), step S12 starts.

In step S12, the maintenance controller 705 controls the elements for performing the first cleaning (e.g., the wiper driver 532, the wiper 20*b*, the head driver 510, and the recording head 4) or the elements for performing the second cleaning (e.g., the suction driver 523, the sucking portion 524, the wiper driver 532, the wiper 20*b*, the head driver 510, and the recording head 4) to perform the first cleaning or the second cleaning on the recording head 4, among the recording heads 4 that correspond to the plurality of first cleaning counters and the plurality of second cleaning counters that count the count values exceeding the first cleaning threshold and the second cleaning threshold, respectively, according to the predetermined order of priority.

A detailed description is provided of the order of priority.

As described above, the second cleaning includes more processes than the first cleaning, thus serving as the superior maintenance compared to the first cleaning. If the recording head 4 needs the second cleaning, that is, if the count value exceeds the second cleaning threshold, the recording head 4 needs early cleaning. To address this circumstance, the inkjet printer 100 according to the first embodiment provides an order of priority based on the type of cleaning in which the second cleaning has priority over the first cleaning.

Accordingly, the maintenance controller 705 selects the recording head 4 to be cleaned with the second cleaning on a priority basis from among the recording heads 4 that correspond to a plurality of counters, that is, the first counter 701, the second counter 702, and the third counter 703, thus cleaning the selected recording head 4 with the second cleaning. Accordingly, step S9 starts.

Alternatively, the maintenance controller 705 may control the cleaner 102 to selectively clean the recording head 4 for which a count value counted by the counter is greatest among the plurality of recording heads 4. The maintenance controller 705 may control the cleaner 102 to clean the recording heads 4 according to the order of priority based on the type of cleaning and the recording heads 4 depicted in table 2.

If the determiner 704 determines that none of the first cleaning counters counts the count value that exceeds the first cleaning threshold or none of the second cleaning counters counts the count value that exceeds the second cleaning threshold (NO in step S6), step S7 starts.

In step S7, the maintenance controller 705 determines whether or not a plurality of count values counted by the plurality of counters is closest to the first cleaning threshold or the second cleaning threshold. If the maintenance controller 705 determines that the plurality of count values counted by the plurality of counters is closest to the first cleaning threshold or the second cleaning threshold (YES in step S7), step S12 starts. Conversely, if the maintenance controller 705 determines that a single count value is closest to the first cleaning threshold or the second cleaning threshold (NO in step S7), step S8 starts.

In step S8, the maintenance controller 705 controls the elements for performing the first cleaning (e.g., the wiper driver 532, the wiper 20*b*, the head driver 510, and the recording head 4) or the elements for performing the second cleaning (e.g., the suction driver 523, the sucking portion 524, the wiper driver 532, the wiper 20*b*, the head driver 510, and the recording head 4) to perform the first cleaning or the second cleaning on the recording head 4 that corresponds to the counter that counts the count value closest to the first cleaning threshold or the second cleaning threshold. Accordingly, step S9 starts.

After the single recording head 4 selected as described above is cleaned, the first cleaning counter or the second cleaning counter that corresponds to the cleaned recording head 4 resets the count value in step S9.

If the inkjet printer 100 performs the second cleaning that includes more processes than the first cleaning, the second cleaning counter that corresponds to the recording head 4 treated with the second cleaning resets the count value. Additionally, the first cleaning counter that corresponds to the recording head 4 treated with the second cleaning also resets the count value.

After the first cleaning counter or the second cleaning counter resets the count value in step S9, the printing controller 706 resumes printing in step S10 and step S1 starts.

A description is provided of advantages of the inkjet printer 100 according to the first embodiment.

As described above, the inkjet printer 100 according to the first embodiment limits a number of the recording heads 4 that are cleaned in a single cleaning, thus cleaning the single recording head 4 in the single cleaning. Accordingly, a time taken for the single cleaning is minimized to a time taken to clean the single recording head 4. Consequently, the inkjet printer 100 does not spend an increased time to clean the entirety of the recording heads 4, preventing uneven drying of the recording heads 4 before and after cleaning and therefore preventing uneven density of an image printed on a sheet 10.

A description is provided of a configuration of the inkjet printer 100 according to a second embodiment of the present disclosure.

Vapor from ink causes condensation on the recording head 4. Hence, as a printing rate defined by an amount of ink discharged from the recording head 4, a number of scanning, and the like increases, a condensation amount of the recording head 4 increases easily. To address this circumstance, considering a printing condition (e.g., the number of scanning), the cleaning off time in seconds described above may be calculated according to formula 2 below.

$$t1=\Sigma(TC\times SC\times t2) \quad 2$$

In formula 2, t1 represents the cleaning off time in seconds. TC represents the temperature coefficient. SC represents a coefficient for the number of scanning. t2 represents the decapping time in seconds.

Table 3 below illustrates one example of the coefficient for the number of scanning.

TABLE 3

| Number of scanning | Coefficient |
|---|---|
| Smaller than 12 passes | γ |
| Not smaller than 12 passes and smaller than 36 passes | β |
| Not smaller than 36 passes | α |

In table 3, γ is smaller than β that is smaller than α.

As illustrated in table 3, the coefficient for the number of scanning changes depending on a number of print passes. As the number of scanning increases, the coefficient for the number of scanning increases, advancing a cleaning time. Conversely, as the number of scanning decreases, the cleaning time is delayed. Since the number of scanning does not change during printing, the CPU 501 determines the coefficient for the number of scanning when printing starts or at an interval between printing on a previous page and printing on a subsequent page.

As described above, each of the first counter 701, the second counter 702, and the third counter 703 counts the decapping time by considering the coefficient for the number of scanning also. Thus, the CPU 501 calculates a count value that indicates the condensation amount of the recording head 4 more precisely. Accordingly, the inkjet printer 100 according to the second embodiment performs the first cleaning and the second cleaning at more appropriate times, respectively, while attaining advantages equivalent to the advantages of the inkjet printer 100 according to the first embodiment described above.

A description is provided of a configuration of the inkjet printer 100 according to a third embodiment of the present disclosure.

Vapor from ink causes condensation on the nozzle face of the recording head 4 (e.g., dew drops adhered to the nozzle face of the recording head 4). Hence, time, temperature, and humidity affect condensation on the recording head 4 substantially. To address this circumstance, the inkjet printer 100 according to the third embodiment incorporates the condensation amount estimator 707 depicted in FIG. 5.

The condensation amount estimator 707 counts a time sent from the timer 507 and estimates the condensation amount based on the counted time. The condensation amount estimator 707 estimates the condensation amount based on output from a temperature detector and a humidity detector, that is, temperatures and a humidity detected by the sensor-actuator 517 depicted in FIG. 4A. For example, the temperatures include a temperature of a heater (e.g., the first heater 3A, the second heater 3B, the third heater 3C, and the fan heater 3D), a temperature of a recording head (e.g., the recording heads 4), and a temperature inside a body of the inkjet printer 100. The temperature of the heater and the temperature of the recording head are sensitive. As the temperature of the heater increases and the temperature of the recording head decreases, the condensation amount increases. As the printing rate increases, an amount of vapor from ink increases. To address this circumstance, the condensation amount estimator 707 estimates the condensation amount based on an amount of ink discharged from the recording head 4, a number of scanning of the carriage 3, or the like also.

The determiner 704 multiplies count values counted by the first cleaning counter and the second cleaning counter, respectively, of each of the first counter 701, the second counter 702, and the third counter 703 by a coefficient for the estimated condensation amount that corresponds to the condensation amount estimated by the condensation amount estimator 707, and sums up, thus calculating the cleaning off time in seconds described above.

$$t1=\Sigma(TC\times SC\times CC\times t2) \quad 3$$

In formula 3, t1 represents the cleaning off time in seconds. TC represents the temperature coefficient. SC represents the coefficient for the number of scanning. CC represents the coefficient for the estimated condensation amount. t2 represents the decapping time in seconds.

As described above, the CPU 501 selects the recording head 4 to be cleaned by considering the estimated condensation amount also. Accordingly, the inkjet printer 100 according to the third embodiment performs the first cleaning and the second cleaning at more appropriate times, respectively, while attaining advantages equivalent to the advantages of the inkjet printer 100 according to the first embodiment and the second embodiment described above.

Alternatively, the condensation amount estimator 707 may estimate the condensation amount based on a type of a medium (e.g., a print target) selected by the user or a gap (e.g., a distance) between the recording head 4 and the medium, that is detected by a gap detector. The condensation amount estimator 707 may estimate or determine the condensation amount directly based on a captured image on the nozzle face of the recording head 4, that is shot by a camera. The condensation amount estimator 707 may estimate or determine the condensation amount by measuring reflected light that is emitted onto the nozzle face of the recording head 4 and reflected by the nozzle face of the recording head 4. In either case also, the inkjet printer 100 attains advantages equivalent to the advantages described above.

The embodiments described above are examples and do not limit the scope of the present disclosure. The embodiments of the present disclosure may be modified variously within the scope of the present disclosure, by omission, replacement, modification, and the like.

For example, each of the embodiments described above is an example in which the technology of the present disclosure is applied to the inkjet printer 100 that discharges ink droplets onto a recording medium to produce a print. Alternatively, the technology of the present disclosure may be applied to a stereoscopic shaping apparatus or a three-dimensional modeling apparatus that discharges hardening liquid onto layered powder and hardens the powder to fabricate a three-dimensional object. In this case, the technology of the present disclosure is applied to cleaning of a plurality of discharging heads that discharges the hardening liquid onto the powder, thus attaining advantages equivalent to the advantages described above.

The above-described embodiments and modifications thereof are encompassed by the scope and the substance of the present disclosure and are equivalents of the present disclosure.

A description is provided of advantages of a maintenance device (e.g., the maintenance device 101).

As illustrated in FIGS. 4B, 5, and 11, the maintenance device includes a plurality of heads (e.g., the recording heads 4), a cleaner (e.g., the cleaner 102), a cleaning controller (e.g., the maintenance controller 705), a determiner (e.g., the determiner 704), and an interruption-resumption controller (e.g., the printing controller 706).

The cleaner selectively cleans the plurality of heads that discharges liquid for printing. The cleaning controller controls the cleaner. The determiner determines a cleaning time when the cleaner cleans one of the heads. The interruption-resumption controller controls interruption and resumption of printing with the liquid, that is, forming an image or an object with the liquid. At the cleaning time when the cleaner cleans the one of the heads, that is determined by the determiner, the interruption-resumption controller controls the heads to interrupt printing. When the cleaner finishes cleaning the one of the heads, the interruption-resumption controller controls the heads to resume printing. Whenever the interruption-resumption controller controls the heads to interrupt printing at the cleaning time when the cleaner cleans the one of the heads, the cleaning controller controls the cleaner to clean the one of the heads.

Accordingly, the maintenance device prevents uneven density in printing that may generate before and after cleaning of a plurality of heads with a configuration in which the plurality of heads is cleaned.

According to the embodiments described above, the inkjet printer 100 serving as a liquid discharge apparatus is a printer. Alternatively, the liquid discharge apparatus may be a copier, a facsimile machine, a multifunction peripheral (MFP) having at least two of printing, copying, facsimile, scanning, and plotter functions, or the like.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A maintenance device comprising:

a plurality of heads configured to discharge liquid for printing;

a cleaner configured to selectively clean the heads;

a counter, associated with each head of the plurality of heads, configured to count time relating to usage of said each head;

a cleaning controller configured to control the cleaner;

a determiner configured to determine a cleaning time when the cleaner cleans one of the heads, wherein the determiner is further configured to select a head to be cleaned from the plurality of heads based on the counter associated with said each head; and an interruption-resumption controller configured to control the heads to interrupt printing at the cleaning time and resume printing when the cleaner finishes cleaning at least one selected head of the plurality of heads, wherein the cleaning controller is further configured to control the cleaner to clean the selected head whenever the interruption-resumption controller controls the heads to interrupt printing at the cleaning time.

2. The maintenance device according to claim 1, further comprising:

a plurality of covers configured to cover the plurality of heads, respectively, wherein the counter associated with each head of the plurality of heads is further configured to count decapping times that elapse continuously after the covers are removed from said each head, respectively, during printing.

3. The maintenance device according to claim 2, wherein the determiner is configured to determine the cleaning time based on the decapping time.

4. The maintenance device according to claim 3, further comprising:

a heater configured to heat the liquid discharged from the heads;

a heater temperature sensor configured to detect a temperature of the heater; and a head temperature detector configured to detect a temperature of each of the heads.

5. The maintenance device according to claim 4, wherein the determiner is configured to determine a temperature coefficient based on a temperature difference between the temperature of the heater and the temperature of each of the heads and determine the cleaning time based on the temperature coefficient in addition to the decapping time.

6. The maintenance device according to claim 5, further comprising a condensation amount estimator configured to estimate a condensation amount of each of the heads based on the decapping time.

7. The maintenance device according to claim 6, wherein the determiner is configured to determine the cleaning time based on the condensation amount in addition to the temperature coefficient and the decapping time.

8. The maintenance device according to claim 1, wherein the determiner is configured to select the head to be cleaned by the cleaner is further based on an order of priority preset for the heads and based on an order of priority preset for each of multiple types of cleaning.

9. The maintenance device according to claim 1, wherein the cleaner includes:

a wiper configured to wipe the one of the heads; and a sucking portion configured to suck the liquid from the one of the heads.

10. The maintenance device according to claim 9, wherein the cleaning controller is configured to control the cleaner to perform a first cleaning including a wiping process in which the wiper wipes the selected head.

11. The maintenance device according to claim 10, wherein the cleaning controller is configured to control the cleaner to perform a second cleaning including a sucking process in which the sucking portion sucks the liquid from the one of the heads and the wiping process in which the wiper wipes the selected head.

12. A liquid discharge apparatus comprising the maintenance device according to claim 1.

13. A maintenance method comprising:

discharging liquid from a plurality of heads for printing;

counting time of usage for each head of the plurality of heads;

determining a cleaning time when a cleaner cleans one of the heads;

selecting the one of the heads to be cleaned by the cleaner, wherein selection of the one of the heads is based on the time of usage for each head of the plurality of heads;

controlling the heads to interrupt printing at the cleaning time;

controlling the cleaner to clean the one of the heads; and controlling the heads to resume printing when the cleaner finishes cleaning the one of the heads.

14. The maintenance method according to claim 13, wherein counting time of usage of each head comprises counting a decapping time that elapses continuously after a plurality of covers is removed from the plurality of heads, respectively, during printing.

15. The maintenance method according to claim 14, further comprising:

heating the liquid discharged from the heads with a heater;

detecting a temperature of the heater;

detecting a temperature of each of the heads;

determining a temperature coefficient based on a temperature difference between the temperature of the heater and the temperature of each of the heads; and determining the cleaning time based on the temperature coefficient in addition to the decapping time.

16. The maintenance method according to claim 15, further comprising:

estimating a condensation amount of each of the heads based on the decapping time; and determining the cleaning time based on the condensation amount in addition to the temperature coefficient and the decapping time.

17. The maintenance method according to claim 13, further comprising:

presetting an order of priority of the heads, wherein selecting the one of the heads is further based on the preset order of priority of the heads.

18. A non-transitory recording medium storing a plurality of instructions which, when executed by at least one processor, causes the at least one processor to perform a method, the method comprising:

discharging liquid from a plurality of heads for printing;

counting time of usage for each head of the plurality of heads;

determining a cleaning time when a cleaner cleans one of the heads;

selecting the one of the heads to be cleaned by the cleaner, wherein selection of the one of the heads is based on the time of usage for each head of the plurality of heads;

controlling the heads to interrupt printing at the cleaning time;

controlling the cleaner to clean the one of the heads; and controlling the heads to resume printing when the cleaner finishes cleaning the one of the heads.

* * * * *